US012668392B2

(12) United States Patent
Parkinson

(10) Patent No.: US 12,668,392 B2
(45) Date of Patent: Jun. 30, 2026

(54) HEAT-SEAL BAND SYSTEM WITH HEAT TUNABILITY THROUGH AN AIR GAP ARRANGEMENT

(71) Applicant: Force Global—ROPEX America LLC, Germantown, WI (US)

(72) Inventor: Michael Parkinson, Hubertus, WI (US)

(73) Assignee: Force Global—ROPEX America LLC, Germantown, WI (US)

( * ) Notice: Subject to any disclaimer, the term of this patent is extended or adjusted under 35 U.S.C. 154(b) by 0 days.

(21) Appl. No.: 18/390,520

(22) Filed: Dec. 20, 2023

(65) Prior Publication Data

US 2024/0294287 A1 Sep. 5, 2024

Related U.S. Application Data

(60) Provisional application No. 63/449,418, filed on Mar. 2, 2023.

(51) Int. Cl.
*B65B 51/18* (2006.01)
*B65B 51/10* (2006.01)

(52) U.S. Cl.
CPC ..... *B65B 51/18* (2013.01); *B65B 2051/105* (2013.01)

(58) Field of Classification Search
CPC ..... B29C 66/1122; B29C 66/849; B29C 65/7461; B65B 51/18; B65B 2051/105
USPC ..... 53/373.7
See application file for complete search history.

(56) References Cited

U.S. PATENT DOCUMENTS 3,369,954 A * 2/1968 Fener ..... B29C 65/224 219/243
3,425,887 A * 2/1969 Bowen ..... B29C 65/224 156/530
10,894,373 B2 * 1/2021 Scrivani ..... B29C 65/7461
2012/0241074 A1 9/2012 Parkinson

OTHER PUBLICATIONS

EP Search Report dated Jun. 17, 2024 from EP App. No. 23219523.0 (8 pages).

* cited by examiner

*Primary Examiner* — Kristina N Junge
(74) *Attorney, Agent, or Firm* — Boyle Fredrickson, S.C.

(57) ABSTRACT

A heat-seal band system is provided with an air gap arrangement that facilitates heat tunability and corresponding balancing of heat distribution through a tab to band (tab/band) junction of a heat-seal band. The heat-seal band may be implemented as a closed-contour heat-seal band with a band that has a workpiece facing surface that directs heat toward a workpiece and an opposite surface from which a pair of conductive tabs extend. Tab covers engage at least portions of the tabs to establish air gaps with dimensions that influence energy transmissibility at the tab/band junction. The tab covers may be fixed such as those defined by portions of clamps that hold the tabs and/or variable such as those implemented as replaceable gap gauges of different dimensions. Selecting and mounting different gap gauges facilitates heat tunability through adjusting the air gap to help identify an acceptable amount of heating uniformity about an entire workpiece facing surface of the heat-seal band.

12 Claims, 15 Drawing Sheets

HEAT-SEAL BAND SYSTEM WITH HEAT TUNABILITY THROUGH AN AIR GAP ARRANGEMENT

CROSS REFERENCE TO RELATED APPLICATION

This application claims the benefit of U.S. provisional application No. 63/449,418 filed Mar. 2, 2023 and hereby incorporated by reference.

FIELD OF THE INVENTION

The invention relates generally to heat-sealing and, in particular, to a heat-seal band system with an air gap arrangement that provides spacing of various features at or adjacent a tab to band (tab/band) junction for influencing energy transfer through it and correspondingly balancing heat distribution through a heat-seal band.

BACKGROUND OF THE INVENTION

In heat-sealing or welding of thermoplastic materials, achieving uniform heat distribution about a contoured heat-seal surface can be challenging. This is especially true for heat-sealing procedures that implement closed-perimeter or closed-contour heat-seal bands. That is because closed-contour bands typically require conductive features such as various terminal tabs that connect to the bands at tab to band (tab/band) junctions for transmitting electrical current into and out of the bands. Characteristics of the tabs and the bands as well as aspects of their engagement at the tab/band junction influence how electrical and thermal energy will flow through the transition(s) at the tab/band junction. This can lead to unbalanced energy transfer and nonuniform heating of the bands, especially at or adjacent to the tab/band junction.

Terminal tabs of some closed-contour heat-sealing bands have integrated terminal tabs (inside or outside) that are formed by bending them up from a two-dimensional form that also provides the band, itself. These bent terminal tabs have bend-lines or edges that do not maintain a clean transition between the terminal tabs and heated seal contour. This creates undesired embossments or irregular impressions on the final product.

Terminal tabs of other closed-contour heat-sealing bands include single or double feet at their ends that engage the bands. The feet are typically spot welded to the bands such abutment locations. This creates a step on the underside of the heat-seal band. The step at this abutment junction provides a stack-up of materials that is not uniform in relation to the balance of the heat-seal band contour. In other words, the stack-up of materials provides a greater thickness and an increase in mass at this abutment junction than the remainder of the band, which has a substantially uniform thickness. This step-change in thickness and localized mass increase at the junction creates many thermal issues. To reduce the effects of these issues, efforts such as partial copper cladding has been implemented to create copper offsets or uncladded portions or segments of the tabs to try to increase or decrease heat at the tab/band junction based on, e.g., the size of the offset. However, this approach takes a lot of trial and error to improve the uniformity of heating about the band. Furthermore, a new heat-seal band is required for each different copper offset and corresponding uncladded segment that is checked during the trial-and-error process, which consumes substantial amounts of engineering time and materials.

Managing these various challenges to try maintaining suitable uniformity of heat distribution about heat-sealed surfaces has proven difficult.

SUMMARY OF THE INVENTION

In accordance with a first aspect of the invention, a heat-seal band system includes a heat-seal band that facilitates heat tunability and corresponding balancing of heat distribution through an air gap that influences energy transfer characteristics at a tab/band junction.

In accordance with another aspect of the invention, the air gap is provided as a void space between respective surfaces of the band and another structure that may function as an energy-director, energy-sink, or heatsink at, adjacent, or otherwise near the tab/band junction as an energy transition location.

In accordance with another aspect of the invention, the tab/band junction may define an adjustable tab/band junction with a corresponding adjustable air gap and a variable energy transition. The adjustable tab/band junction allows the amount of heat energy that is accumulated at the junction, where the perpendicular electrical tabs join the contoured heat-seal band's lower surface, to be altered.

In accordance with another aspect of the invention, control of the energy transition through the tab/band junction may be achieved with a tab cover system that includes tab covers that at least partially engage the heat-seal band's tabs. The tab covers may be fixed such as those defined by portions of clamps that hold the tabs with fixed or set dimensions to establish corresponding air gap dimensions. The tab covers may further be variable to allow for adjusting the air gap dimensions and a variable energy transition at the tab/band junction. The variable energy transition at the tab/band junction may be provided by tab gap gauges as the tab covers that selectively engage the tab(s) and may have different dimensions or mount at different heights to provide air gaps with different dimensions. The gap gauges provide an interchangeable heatsink that can be used to balance the energy that flows between the heat-seal band tabs and the energy that flows about the heating surface of the heat-seal band. A set of gap gauges provides multiple pairs of different sized gap gauges. From the set of gap gauges, a pair of matching gap gauges of predetermined dimensions are used to create an air gap at each junction where the heat-seal band mounting tabs are joined to the underside of the heat-seal band heating surface. The area of the heat-seal band tab that is exposed at the junction will determine the amount of heat that is formed at the junction. The less tab surface area exposed at the junction, the more energy will be conducted away from the junction, therefore creating a cooling effect at the heating surface in comparison to the following example. The greater the tab surface area exposed at the junction; the less energy will be conducted away from the junction, therefore creating a heating effect at the heating surface in comparison to the previous example. In this way of adjusting the air gap, heat tuning can be accomplished by implementing a particular pair of gap gauges that provides an interchangeable heatsink that can be used to balance the energy at the junction, making the energy transfer from the tab to the band be equal to the energy about the band's heating surface.

In accordance with another aspect of the invention, each gap gauge may be defined by a segmented body that is configured to engage the tab and overlap different portions or a predetermined length of the tab to provide the corresponding air gap. The gap gauge may define a forked configuration of the gap gauge's segmented body that includes an intermediate shim and a pair of thin sheets or leaves as legs of the fork. The shim provides a mechanical stop that facilitates consistent depth-setting of the gap gauge's mounting on the tab. The pair of legs or leaves of the gap gauge are spaced from each other by a distance that corresponds to a thickness dimension of the tab so that each leg is in face-to-face abutment with a surface of the tab when the gap gauge is fully seated on the tab. The shim may define a strip-like body with a segment that is narrower than the tab and the tab may include a slot that receives the shim to locate it both longitudinally and transversely.

These and other features and aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the scope of the invention.

BRIEF DESCRIPTION OF THE DRA WINGS

Figure 14:
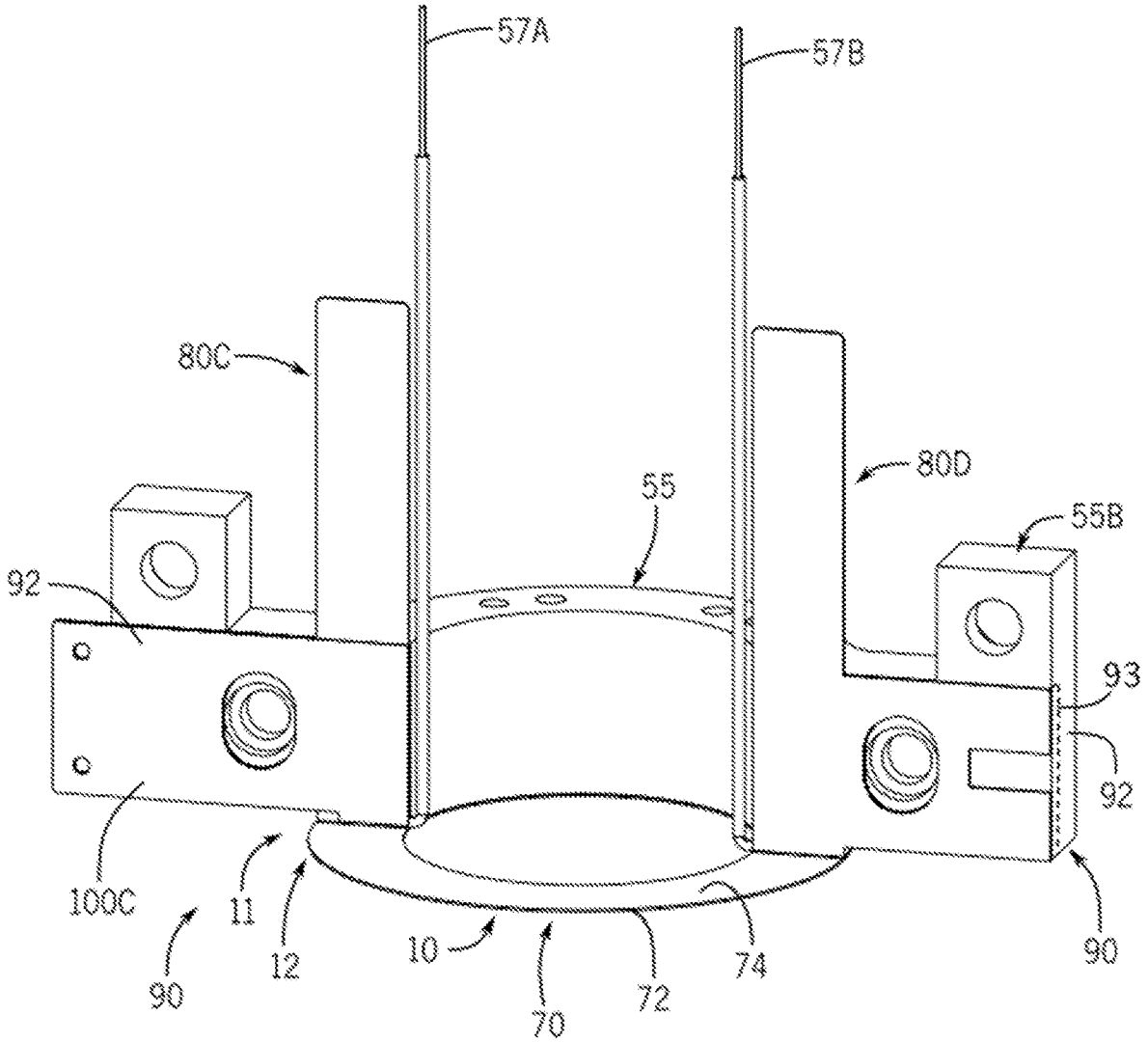
Figure 15:
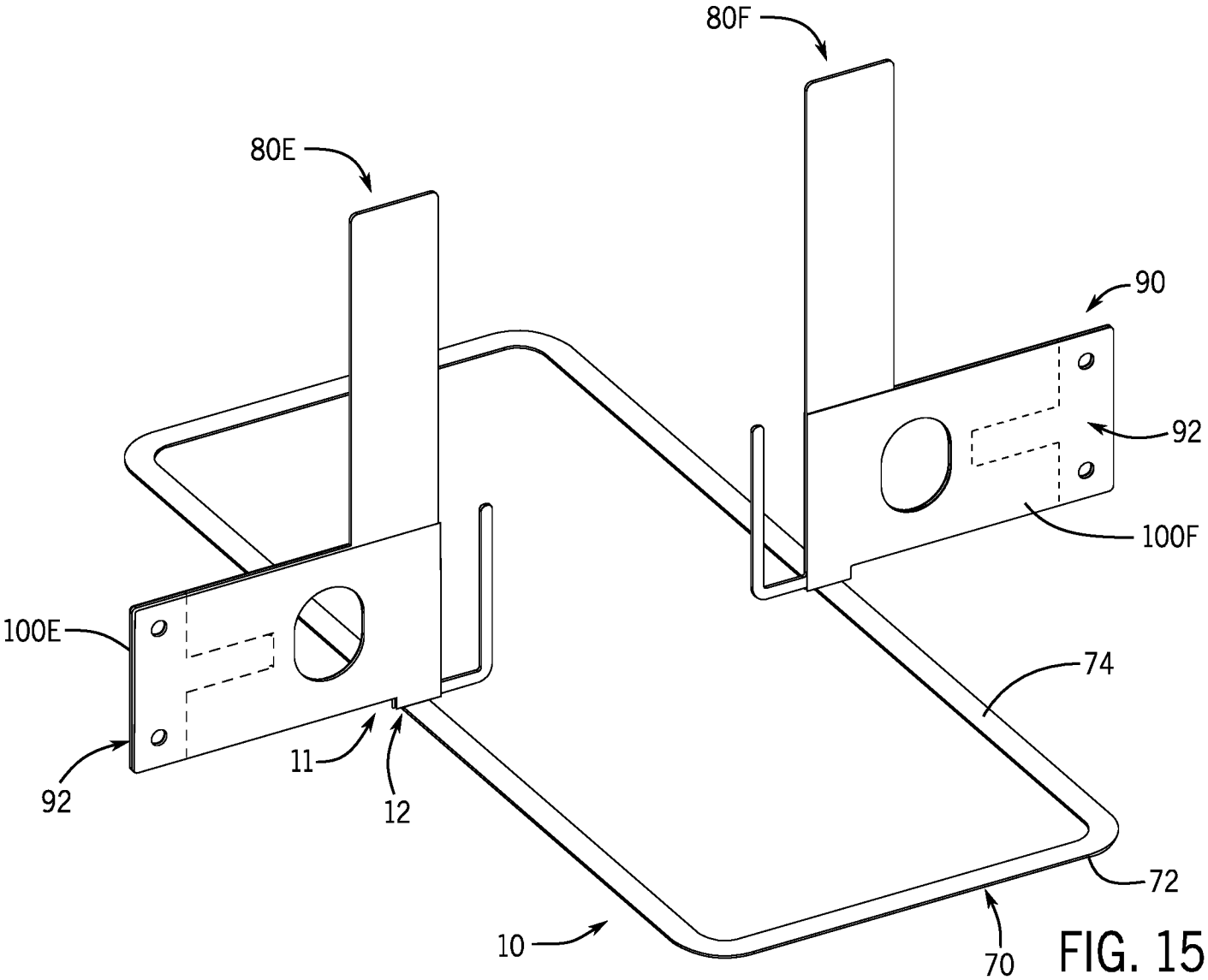
Figure 16:
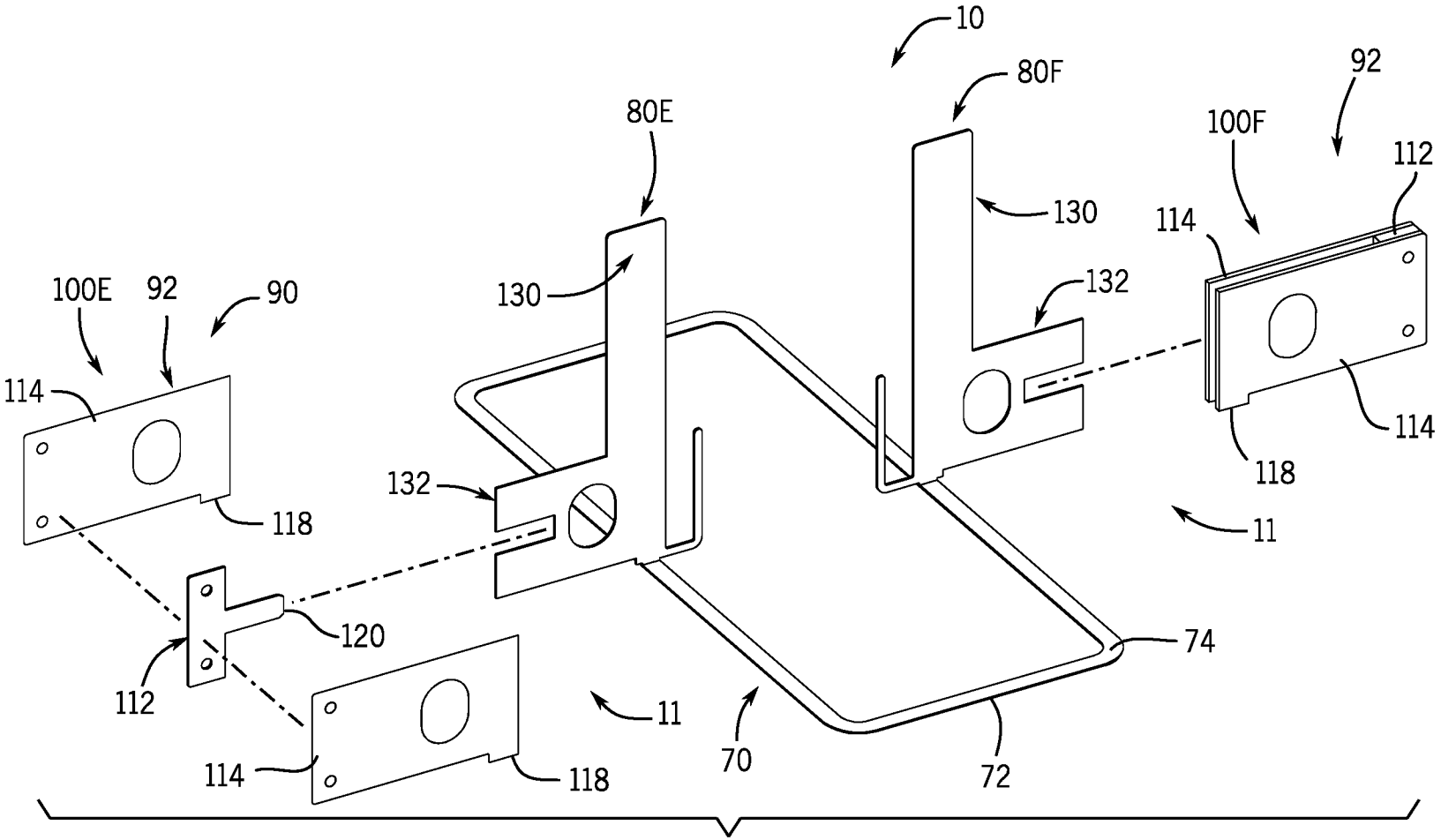

FIG. 14 an isometric view of portions of a heat-seal band and variants of a tab cover system;

FIG. 15 is an isometric view of another heat-seal band and tab cover system; and FIG. 16 is an exploded view of the heat-seal band and tab cover system of FIG. 15.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 1:
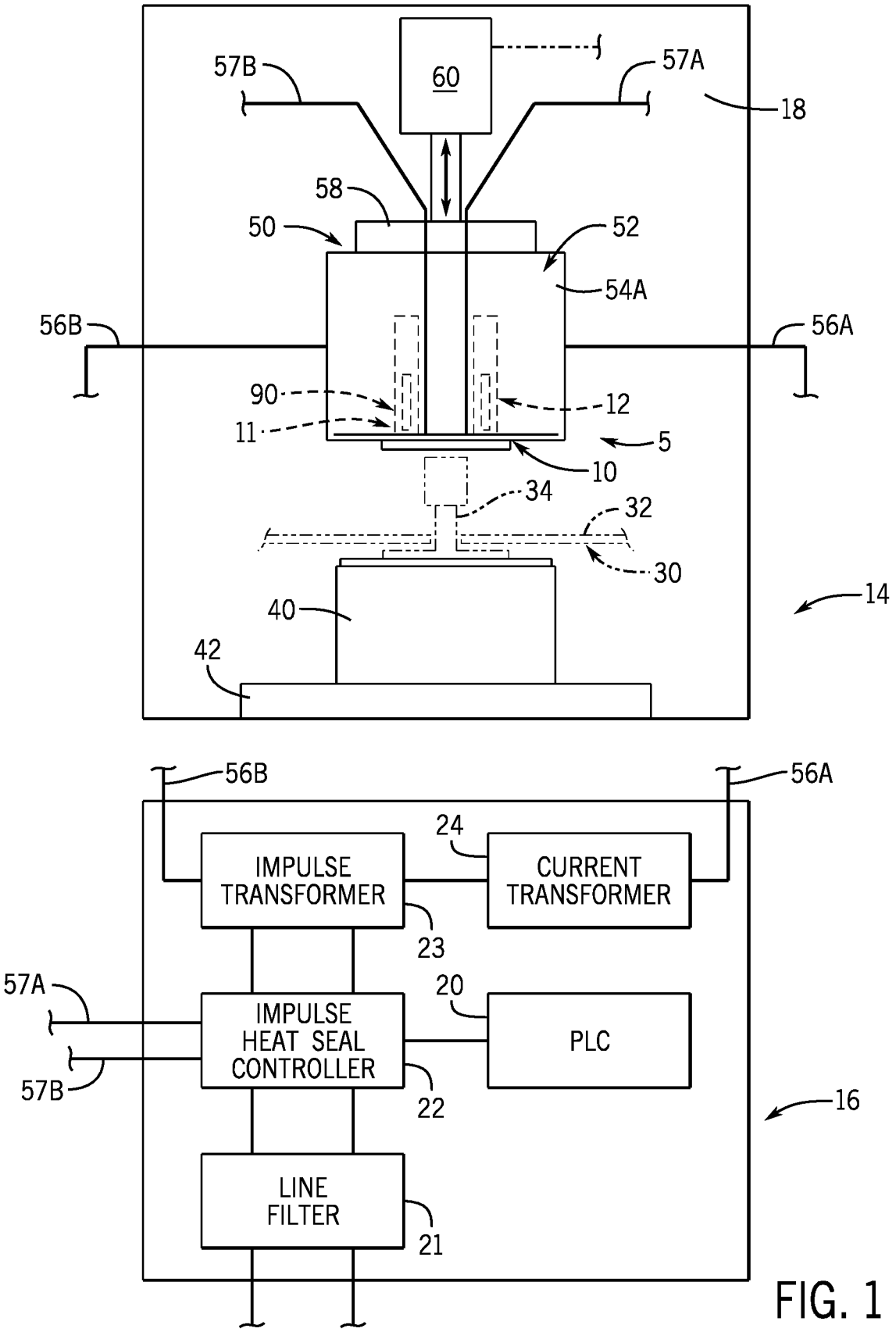
FIG. 1 is a partially schematic view of a heat-seal band system in accordance with various aspects of the invention.

Referring now to the drawings and initially to FIG. 1, a heat-seal band system 5 is shown with heat-seal band 10 that is provided with an air gap arrangement 11 at or near and cooperating with a tab to band (tab/band) junction 12. The air gap arrangement 11 and tab/band junction 12 are configured to facilitate balancing energy transfer through the heat-seal band 10, to improve heating uniformity of workpiece engaging structures during a heat-sealing operation. Air gap arrangement 11 and tab/band junction 12 may provide for heat tunability of the system. This may be achieved through adjustments to various features at or suitably near the tab/band junction 12 to correspondingly adjust dimensions or other aspects of the air gap arrangement 11 and interacting components that influence energy transfer through the tab/band junction 12. The tunability may be used during a preliminary setup procedure to, for example, facilitate determining appropriate air gap dimensions and/or component configuration(s) to provide the desired heating uniformity for a particular application which may then be set or fixed for that application. The tunability may further be implemented with various interchangeable or otherwise adjustable components for ongoing or subsequent adjustments to accommodate different system or use characteristics in order to provide the desired heating uniformity of the workpiece.

Still referring to FIG. 1, heat-seal band 10 is shown being used with a thermal joining or welding system to perform the heat-sealing operation, represented here as an impulse heat-seal system 14 that includes control system 16 and heat-seal machine 18. Control system 16 includes a controller 20 that is typically implemented as a PLC (programmable logic controller), or a microcontroller or other computer that executes various stored programs while receiving inputs from and sending commands to the subsystems of components of the impulse heat-seal system 14. Control system 16 includes various power source systems and components, such as line filter 21, impulse heat seal controller 22, impulse transformer 23, and current transformer 24 for delivering electrical power to various components of the impulse heat-seal system 14.

Still referring to FIG. 1, heat seal machine 18 is configured to perform a thermal joinder procedure such as heat sealing or welding on a workpiece 30, which typically includes multiple workpiece components. Workpiece 30 is shown here with a sheet-like substrate 32 that may, for example, be a segment of a bag or other polymeric or foil enclosure. A discrete component, shown as a fitting 34 that is represented here as having a port-like configuration, is being joined to the substrate 32 of workpiece 30 in this example. Workpiece 30 is shown supported from below by counter-tool 40 that is connected to a counter holder or plate 42, which is supported by a frame of the heat seal machine 18.

Still referring to FIG. 1, heat seal machine 18 includes impulse heat-sealing tool 50 that holds the heat-seal band 10 by clamping it in a clamp shown as bus bar assembly 52 that typically includes a pair of substantially mirror-image clamp segments shown as bus bars 54A, 54B, only one which is visible in this view. Load lines or conductors 56A, 56B connect the bus bars 54A, 54B (FIG. 2) to control system 16, shown here connected to the impulse and current transformers 23, 24. Signal wires or voltage sensing conductors 57A, 57B are connected to control system 16, shown here connected to the impulse heat seal controller 22. Toward the top of the impulse heat-sealing tool 50, an insulated tie plate 58 connects the bus bar assembly 52 halves or bus bars 54A, 54B (FIG. 2) to each other. Actuator 60 connects to a mount of the tie plate 58 and drives the heat-sealing tool 50 into reciprocation between a released or retracted position (shown) in which the workpiece's 30 components can be arranged before their heat-sealing and an engaged or extended position (not shown) in which the heat-sealing tool 50 is moved downwardly to apply pressure and heat from the heat-seal band 10 to the workpiece 30 to perform the heat-sealing procedure. Typically, during the heat-sealing procedure, the heat-sealing tool 50 holds the workpiece 30 under pressure against the counter-tool 40 and allows the weldment to cool under pressure to form the weld or heat-seal.

Figure 2:
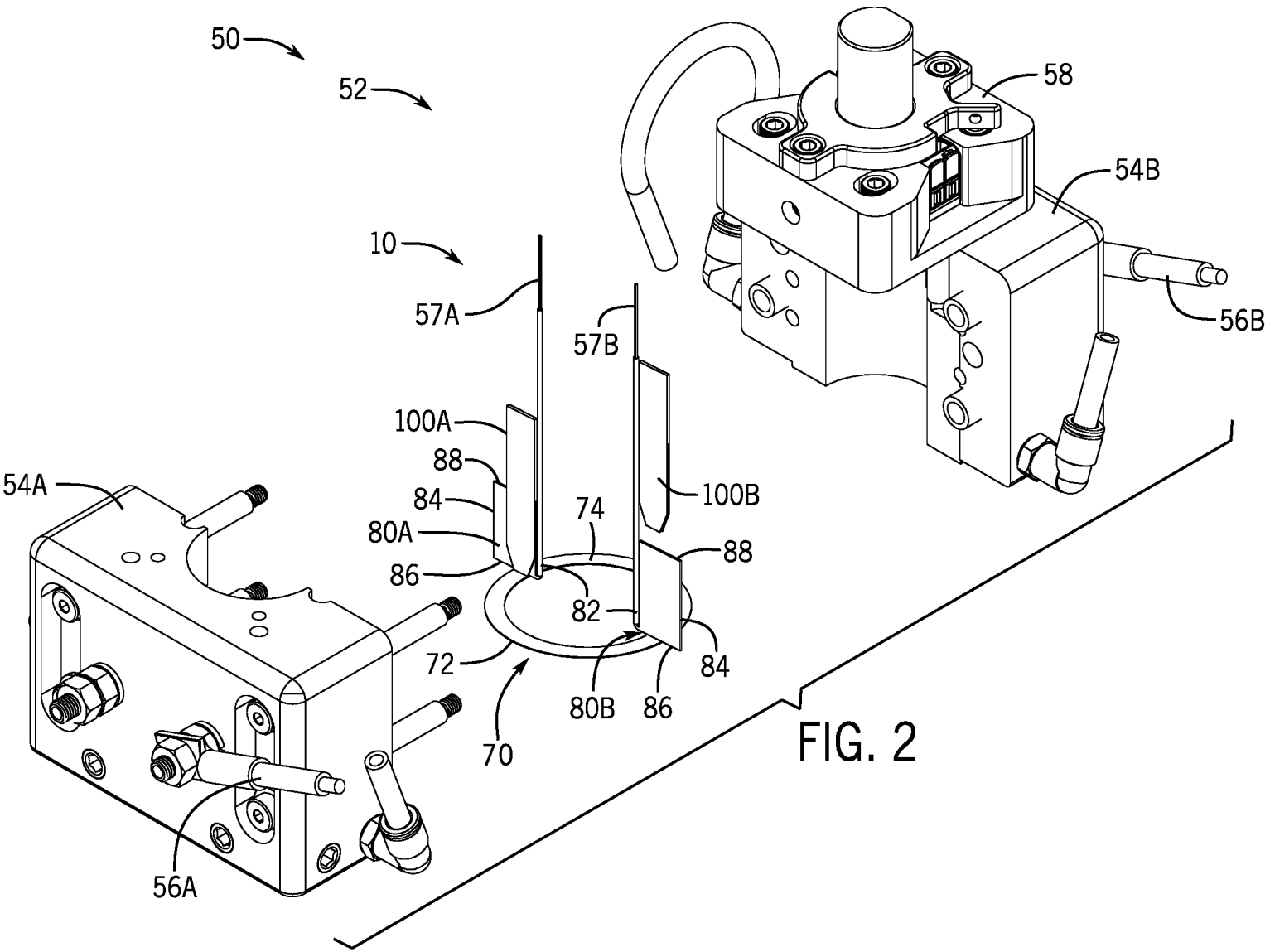
FIG. 2 is a partially exploded isometric view of an impulse heat-sealing tool implementing a heat-seal band in accordance with various aspects of the invention.

Referring now to FIG. 2, the heat-seal band 10 includes a band 70, shown here with a circular or ring-shaped closed-perimeter or closed-contour configuration. Band 70 has a lower or workpiece-facing surface 72 that is configured to direct heat toward the workpiece 30 (FIG. 1) to perform the heat-sealing operation. An opposite upper or tab-facing surface 74 faces upwardly toward the bus bar assembly 52.

Still referring to FIG. 2, heat-seal band 10 receives and transmits electrical current through the bus bars 54A, 54B by way of a conductive tab arrangement, shown here as a pair of conductive tabs 80A, 80B. The tabs 80A, 80B are generally planar structures that are parallel to and coplanar with each other, extending perpendicularly upward from the band's tab-facing surface 74. In this implementation, each tab 80A, 80B has a generally rectangular perimeter shape and is taller than it is wide. Tabs 80A, 80B are shown here as being wider than the material spanning between the band's ID (inside diameter) and OD (outside diameter), with lateral upright inner and outer side edges 82, 84 of the tabs 80A, 80B arranged inwardly and outwardly beyond respective inner and outer circumferential edges of the band. A bottom edge 86 is arranged toward the band 70, sitting against the tab-facing surface 74. An upper edge 88 is arranged opposite the band 70. Regardless of the particular configuration of the tabs, they interact with a tab cover system 90 (FIG. 1) to influence characteristics of energy transfer through the band-tab junction 12.

Figure 3:
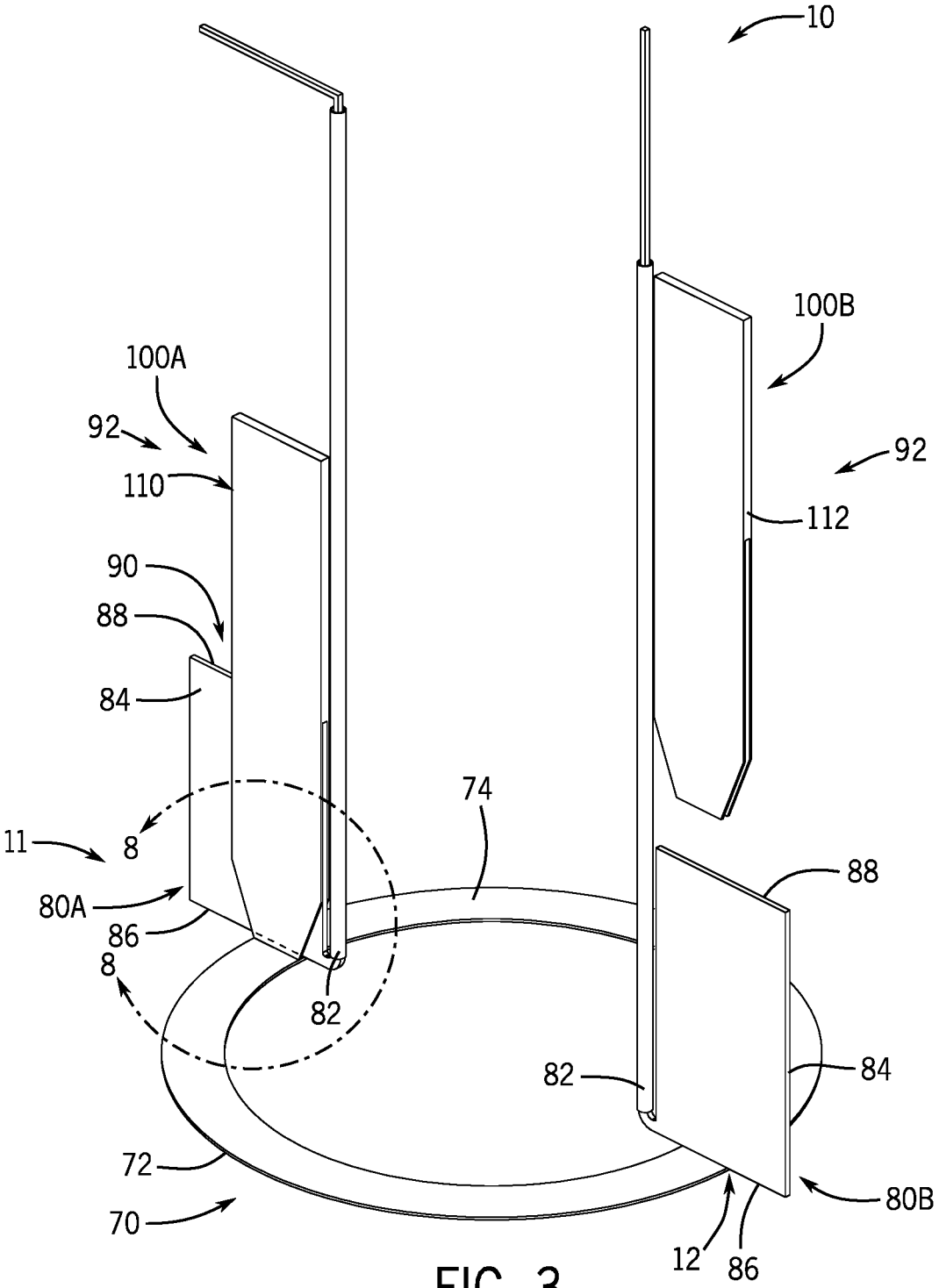
FIG. 3 is a partially exploded isometric view of a heat-seal band and a gap gauge-type tab cover system.

Referring now to FIG. 3, this tab/band junction 12 is shown as an adjustable tab/band junction 12, shown implemented with an adjustable or variable implementation of tab cover system 90. In this adjustable tab/band junction 12, various features of the tabs 80A, 80B, including its surfaces and edges, cooperate with other components to modify various energy transmission-related characteristics of the adjustable tab/band junction 12. The adjustable tab/band junction 12 may be adjusted by way of the tab cover system 90 to selectively cover the tab 80A, 80B to different extents to vary an amount of energy that is transmitted through the tab/band junction 12. This may include sheet-like or other structures that can be selectively installed in the tool 50, such as into the bus bar(s) 54A, 54B (FIG. 2) to influence energy transfer characteristics through the tab/band junction and provide variable heating at the tab/band junction's workpiece-facing surface 12. In one example, the variable tab cover system 90 includes tab covers 92. Tab covers 92 may be fixed features such as stepped segments or defined by various other component surfaces that are configured to engage and overlap various portions of tabs 80A, 80B. Tab covers 92 may also include components that are removably mountable with respect to the tabs 80A, 80B that can be installed in the tool 50. Tab covers 92 are shown here implemented as a gap gauge 100A, 100B that selectively engages the respective tab 80A, 80B to facilitate tuning the energy transmission through the adjustable tab/band junction 12 for improving the heating uniformity of the workpiece-facing surface 72. The gap gauges 100A, 100B represent a matching pair of a set of gap gauges. The set of gap gauges includes multiple different matched pairs of gap gauges that provide different performance characteristics to the adjustable tab/band junction 12 to tune the heat conductivity for improving heating uniformity. Typically, different pairs of gap gauges 100A, 100B have different dimensions to engage different surface areas of the tabs 80A, 80B so that adjustments can be made by mounting different matched pairs of gap gauges 100A, 100B and adjust the dimensions of corresponding air gaps. Besides just dimensional differences, different gap gauges may be made from different materials with different conductivity values to provide differences and adjustability of the tab/band junction 12.

Figure 4:
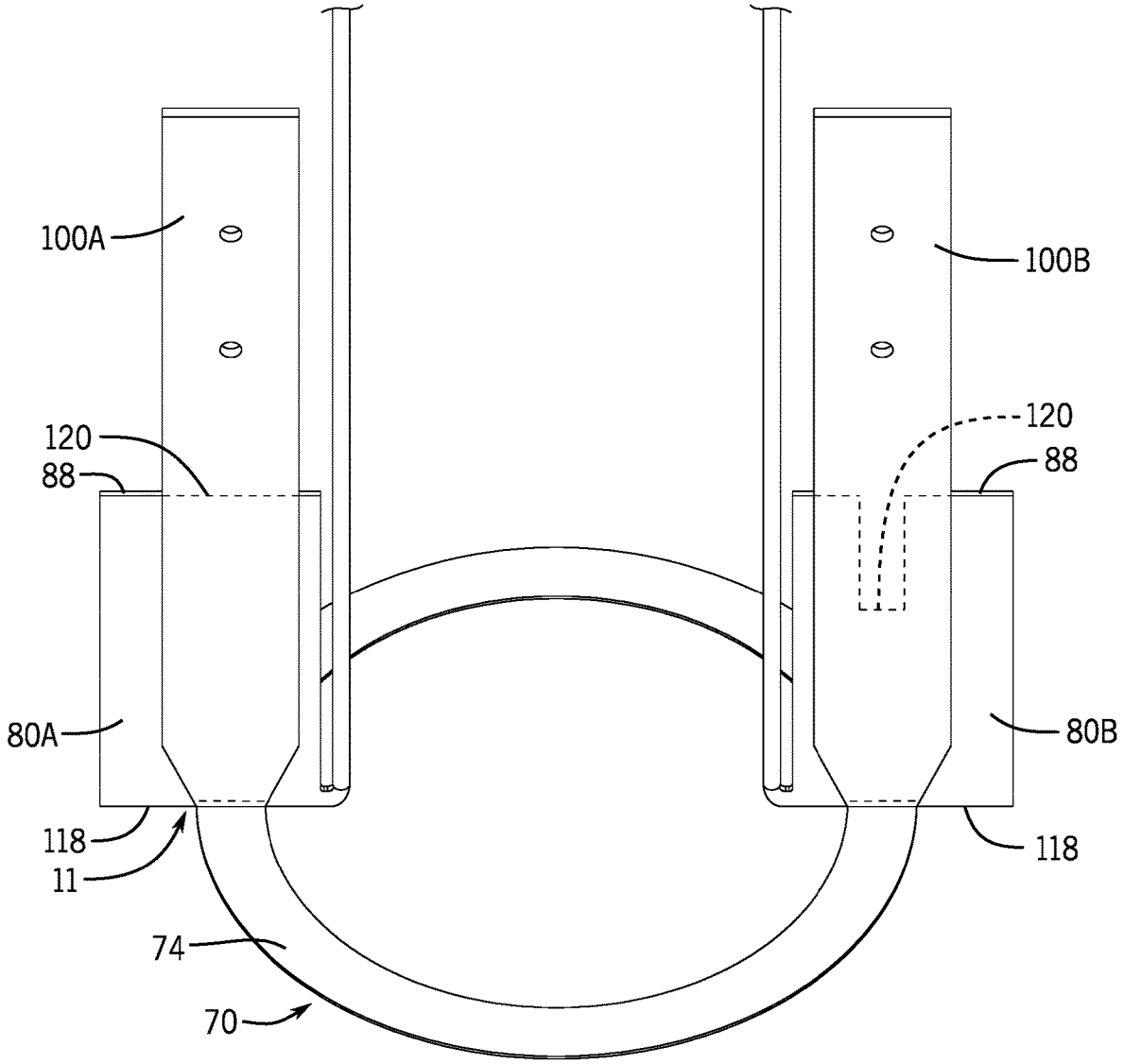
FIG. 4 is an isometric view of a heat-seal band and a gap gauge-type tab cover system.
Figure 5:
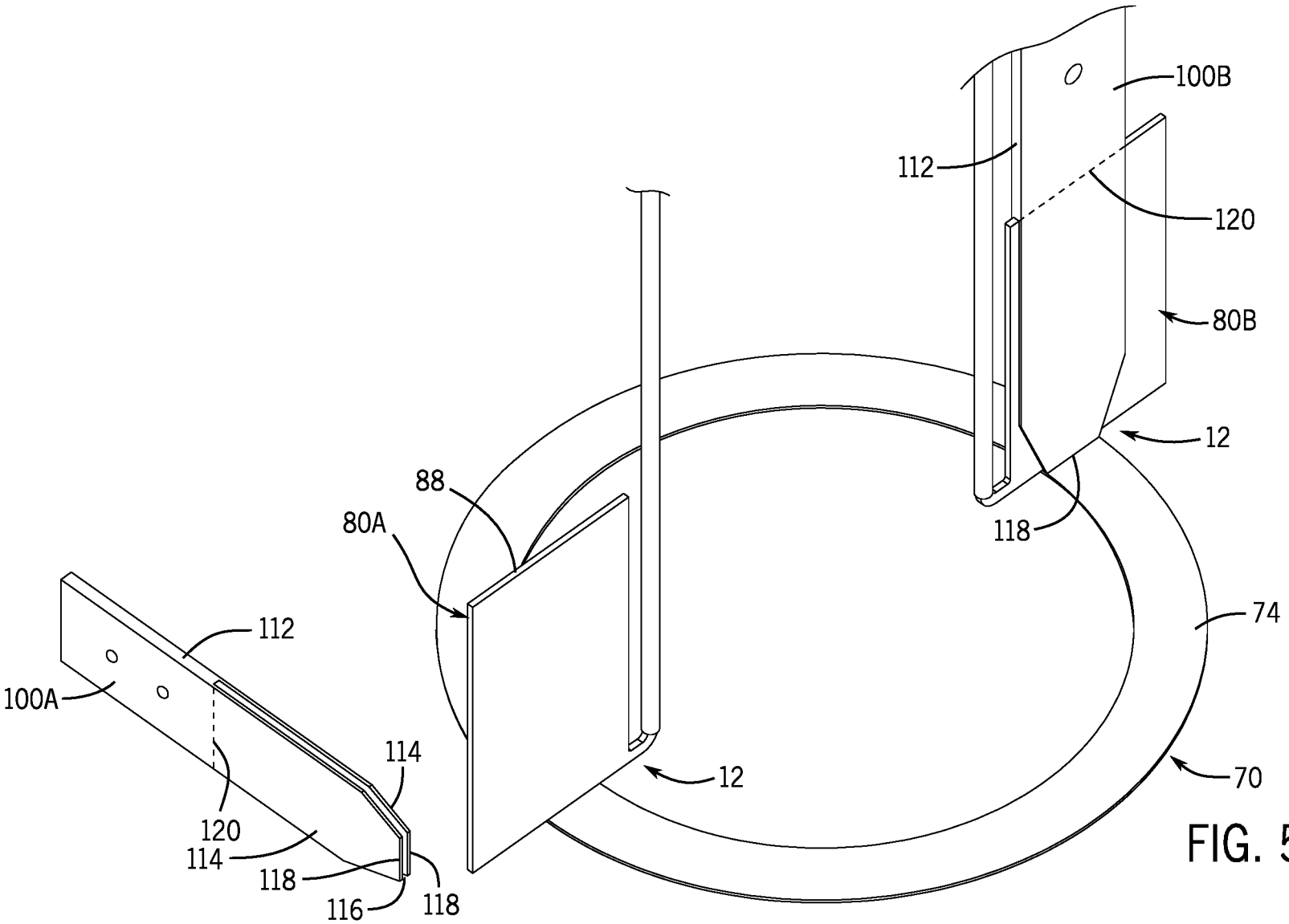
FIG. 5 is another a partially exploded isometric view of a heat-seal band and a gap gauge-type tab cover system.

Still referring to FIG. 3, the gap gauge 100A toward the left is shown installed or seated upon the corresponding tab 80A. The gap gauge 100B toward the right is shown uninstalled with respect to or separated from the corresponding tab 80B. In FIG. 4, both of the gap gauges 100A, 100B of this matched pair of gap gauges are shown seated upon their respective tabs 80A, 80B. Referring now to FIG. 5, the uninstalled gap gauge 100A shows its multi-segment or forked configuration. Gap gauge 100A, 100B includes a segmented body 110 that includes an intermediate shim 112 (shown separated from other components or body segments in FIG. 16) and a pair of thin sheets or leaves as legs 114 of the fork that are spaced from each other and define a fork opening or slot-like opening 116 between them. Lower edges 118 are at the lower ends of legs 114. The shim 112 has a lower edge 120 that provides a mechanical stop that abuts the tab's upper edge 88. The engagement of the shim's lower edge 120 with the tab's upper edge 88 ensures consistent depth setting of the gap gauge 100A, 100B when removably mounted or seated on the tab 80A, 80B. When seated, inner surfaces of the legs 114 engage outer surfaces of the tab 80A, 80B, sandwiching the tab 80A, 80B between the legs 114. Although shim 112 is shown in FIG. 5 extending across the entire width of gap gauge 100A, 100B along a continuous straight-line path (left-hand side of FIG. 4), shim 112 may have other configurations for abutting and interlocking with the respective tab 80A, 80B. Toward the right-hand side of FIG. 4, gap gauge 100B is shown with a shim 112 that includes a strip-like middle segment that can be received in a corresponding slot of tab 80B to longitudinally and transversely lock the shim 112 within the tab 80B.

Referring generally to FIGS. 3-5, different gap gauges 100A, 100B of a set of gap gauges 100A, 100B may have different heights or other different dimensions. Referring again to FIG. 5, the different heights of the gap gauges 100A, 100B may be defined by the distance between the shim's lower edge 120 and the leg's lower edge 118 so that the different gap gauges 100A, 100B overlap the tabs 80A, 80B by different amounts. This spaces the different leg lower edges 118 different distances from the band upper or tab-facing surface 74, which exposes different surface areas of the tab 80A, 80B at the tab/band junction 12 and changes the dimensions of corresponding air gaps at these exposed or uncovered portions.

Figure 6:
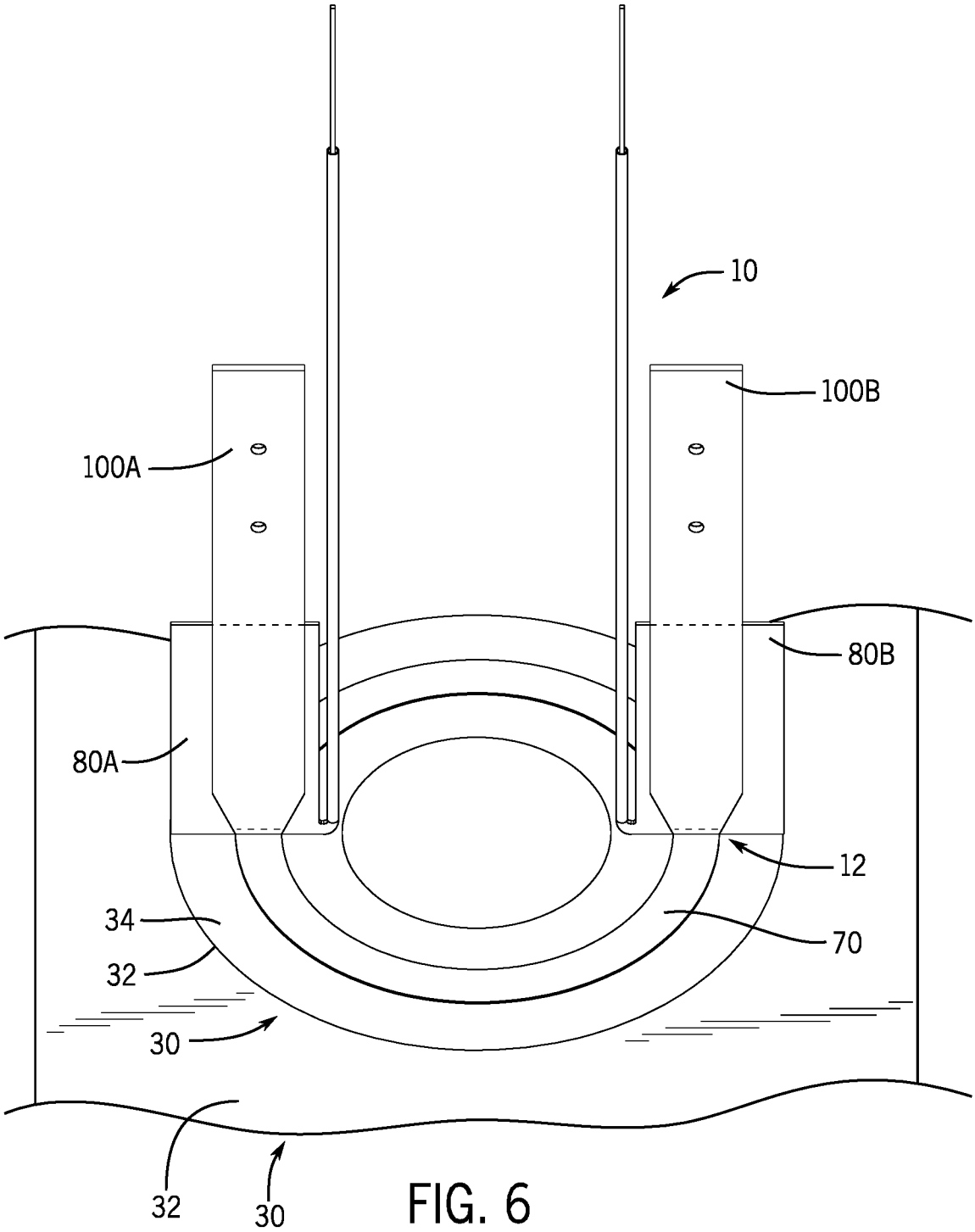
FIG. 6 is another isometric view of a heat-seal band and a gap gauge-type tab cover system.
Figure 7:
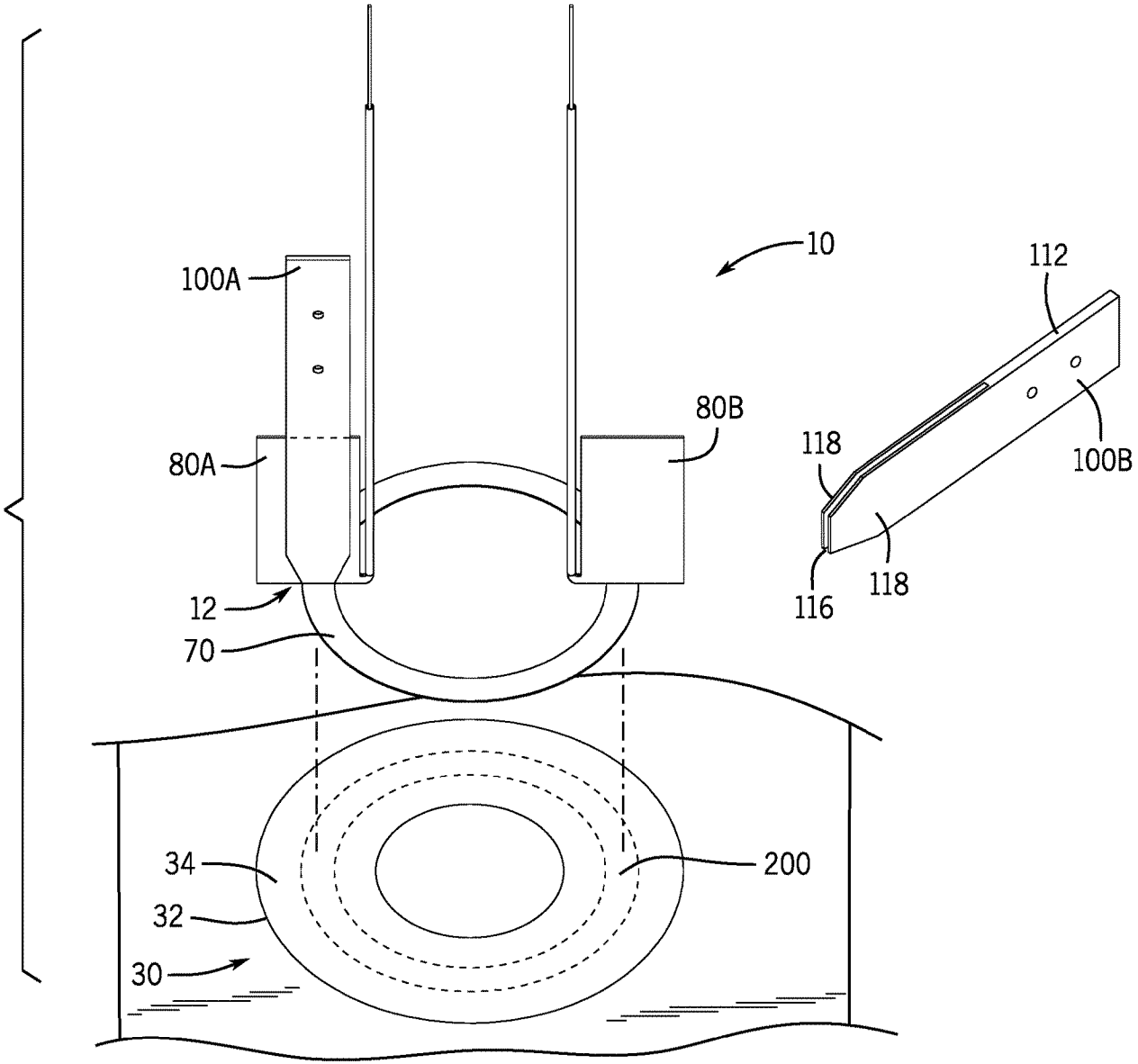
FIG. 7 is another a partially exploded isometric view of a heat-seal band and a gap gauge-type tab cover system.

Referring now to FIGS. 6 and 7, these views are similar to those of FIGS. 4 and 5, only showing the workpiece 30 along with the heat-seal band 10. FIG. 6 shows the heat-seal band 10 engaging the workpiece's stacked arrangement of a film as the substrate 32 and a molded ring as the fitting 34 that will be heat-sealed to the substrate 32. FIG. 7 shows the heat-seal band 10 disengaged from the workpiece 30, with one of its gap gauges 100A still removably mounted to its tab 80A and the other gap gauge 100B uninstalled or removed from its tab 80B. A weld zone 200 can be seen in FIG. 7 that provides a continuous path about the fitting 34 that corresponds to the shape of band 70, which forms the joinder between the substrate 32 and fitting 34.

Figure 8:
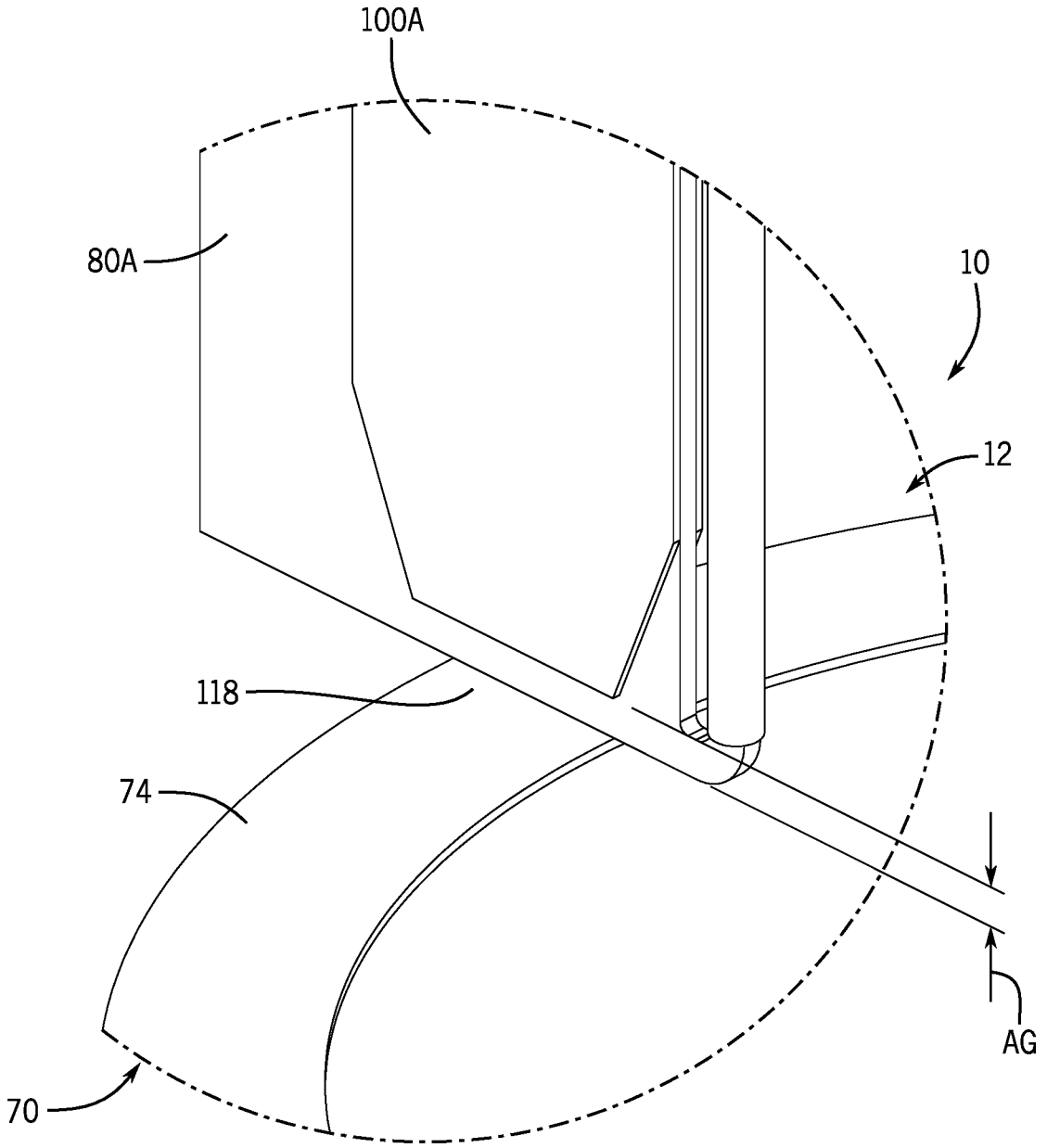
FIG. 8 is a close-up isometric view of a tab/band junction and tab cover system taken at circle 8-8 of FIG. 3.

Referring now to FIG. 8, an air gap AG is defined by the offset distance, air gap distance, or vertical spacing between the band upper or tab-facing surface 74 and the leg lower edge 118 of gap gauge 100A, whereby the air gap distance may correspond to a surface-to-surface spacing between the energy sink and the upper or tab-facing surface 74. A magnitude of the air gap AG dimension relates to an exposed or uncovered surface area of tab 80A at the tab/band junction 12 as well as to conductivity characteristics through the tab/band junction 12.

Figure 9:
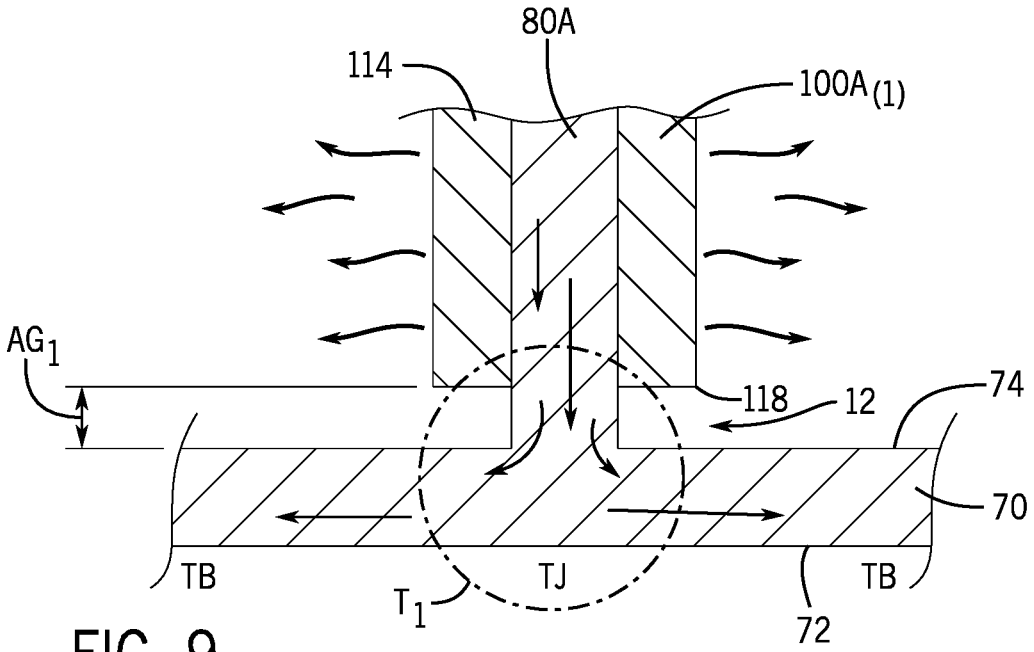
FIG. 9 is a closeup cross-sectional view of a tab/band junction with a first, smaller, air gap.
Figure 10:
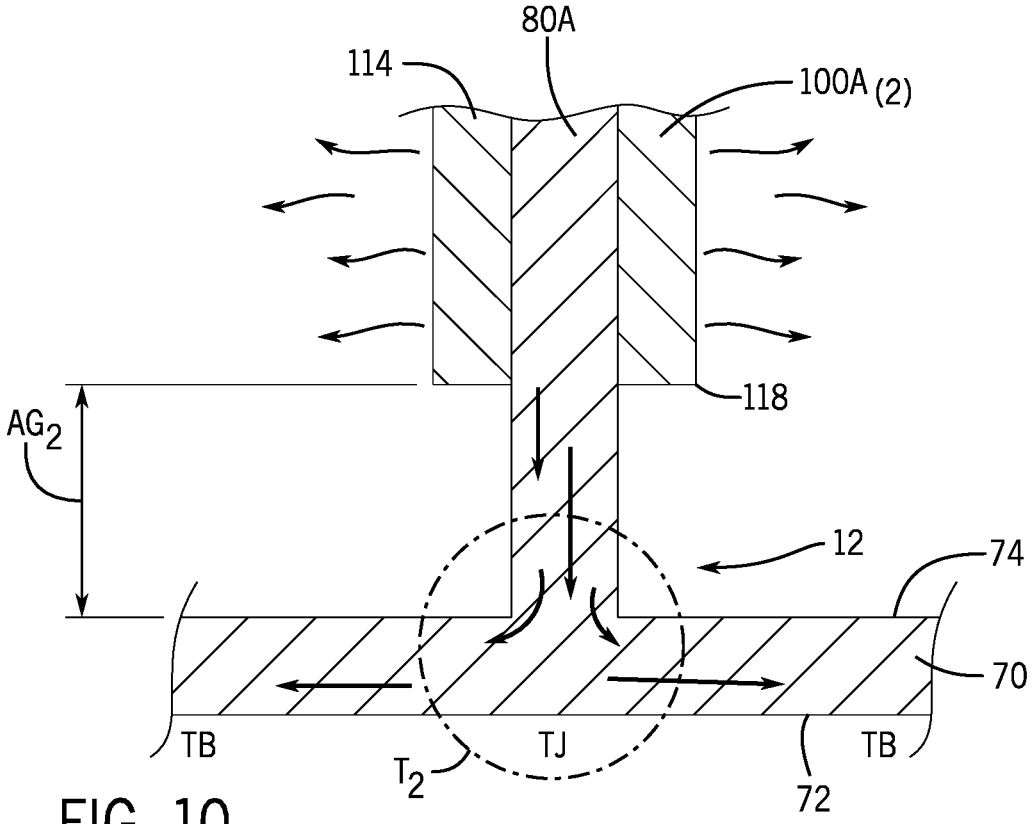
FIG. 10 is a closeup cross-sectional view of a tab/band junction with a second, larger, air gap.

Referring now to FIGS. 9-10, heat tunability is represented by implementing different gap gauges, shown here as gap gauge 100A(1) in FIG. 9 and gap gauge 100A(2) in FIG. 10. Comparing these two different gap gauges, gap gauge 100A(1) in FIG. 9 has longer legs 114 than the legs 114 of gap gauge 100A(2) in FIG. 10. Accordingly, the leg lower edge 114 of gap gauge 100A(1) in FIG. 9 is spaced closer to the band upper or tab-facing surface 74 than the leg lower edge 114 of gap gauge 100A(2) in FIG. 10. Similarly, the air gap AG1 of gap gauge 100A(1) in FIG. 9 is shorter than air gap AG2 of gap gauge 100A(2) in FIG. 10, whereby less surface area at the bottom of tab 80A is exposed in FIG. 9 than in FIG. 10 at the tab/band junction 12.

Still referring to FIGS. 9 and 10, since less tab surface area is exposed at the junction with air gap AG1 in FIG. 9 than with air gap AG2 in FIG. 10, in FIG. 9, more energy will be conducted away from the tab/band junction 12 and less energy will be conducted through the tab/band junction 12. This is represented by the thicker wavy arrows that point away from gap gauge 100A(1) and thinner arrows directed through the tab 80A and band 70 in FIG. 9. Conversely, since more tab surface area is exposed at the junction with air gap AG2 in FIG. 10 than with air gap AG1 in FIG. 9, in FIG. 10, less energy will be conducted away from the tab/band junction 12 and more energy will be conducted through the tab/band junction 12. This is represented by the thinner wavy arrows that point away from gap gauge 100A(2) and thicker arrows directed through the tab 80A and band 70 in FIG. 10. Accordingly, relative cooling or heating can be achieved by replacing a current gap gauge 100A, 100B with a different gap gauge 100A, 100B that provides a different air gap AG dimension, a shorter air gap AG for cooling and a larger air gap AG for heating of the band's workpiece-facing surface 72 through the tab/band junction 12. These temperature differences are represented by temperature T1 in FIG. 9, which is smaller than temperature T2 in FIG. 10.

Still referring to FIGS. 9 and 10, balancing the surface temperature about the entire lower band surface or workpiece-facing surface 72 may be achieved by a tuning procedure in which different gap gauges 100A, 100B are implemented to provide a substantially equivalent surface temperature at the tab/band junction 12 to its adjacent surface and the remainder of band 70. Junction temperature TJ represents the temperature of the workpiece-facing surface 72 at the tab/band junction 12 or directly below the intersection of the tab 80A, 80B and the band 70. Band temperatures TB represents the temperature of the workpiece-facing surface 72 at positions that are spaced from the tab/band junction 12 or beyond the tab/band junction's heat-effected-zone. These band temperatures TB corresponding to the surface temperature(s) adjacent the tab/band junction 12 and along the reminder of the band's workpiece-facing surface 72.

Still referring to FIGS. 9 and 10, typically, the set of gap gauges includes multiple matched pairs of gap gauges with different length legs in consistent increments of leg length that provide consistent increments in air gap length. Such increments may be, for example, multiples of 10-thousanths of an inch, typically multiples of 20-thousanths of an inch, which may provide air gap dimensions of, about 20-thousanths, 40-thousands, 60-thousanths, 80-thousanths of an inch, 100-thousanths of an inch, or other increments. Besides selecting identical length gap gauges 100A, 100B as a matched pair, the pair of gap gauges 100A, 100B may be implemented in different leg lengths to engage the tabs 80A, 80B to facilitates temperatures balancing when the tab/band junctions 12 at the tabs 80A, 80B have different energy transfer characteristics. Such different energy transfer characteristics at the different tab/band junctions 12 for he different tabs 80A, 80B may occur when, for example, the contour or band 70 has different shapes, features, or other configurations at the different tab/band junctions 12 or due to irregularities of the heat-seal band's 10 construction. These purposeful differences or manufacturing irregularities can be compensated for to achieve equivalent junction temperatures TJ at the different tab/band junctions 12 corresponding band temperatures TB along the remainder of the band's workpiece-facing surface 72 by implementing gap gauges 100A, 100B with different leg length to attenuate any temperatures differentials between the junction temperatures TJ and band temperature(s) TB.

Figure 11:
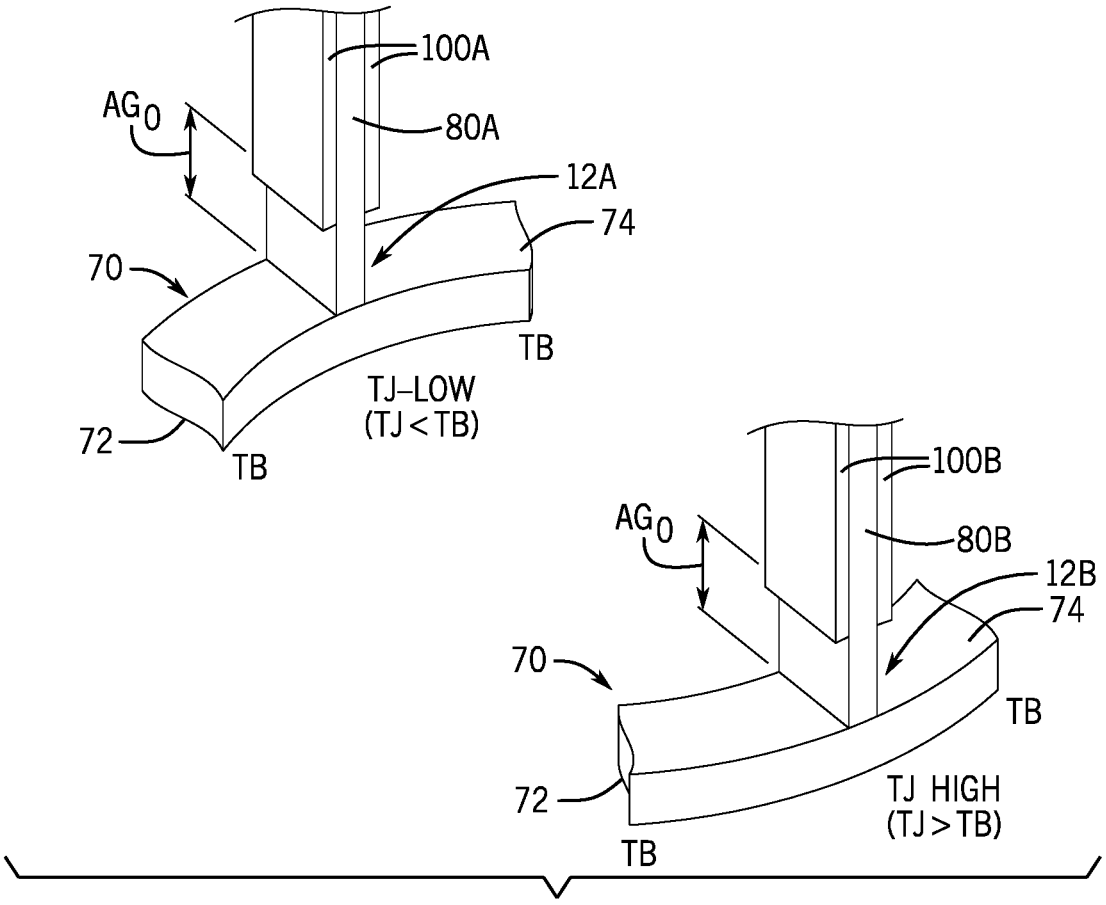
FIG. 11 is a closeup isometric view of tab/band junctions representing states that require energy transmission tuning procedures.
Figure 12:
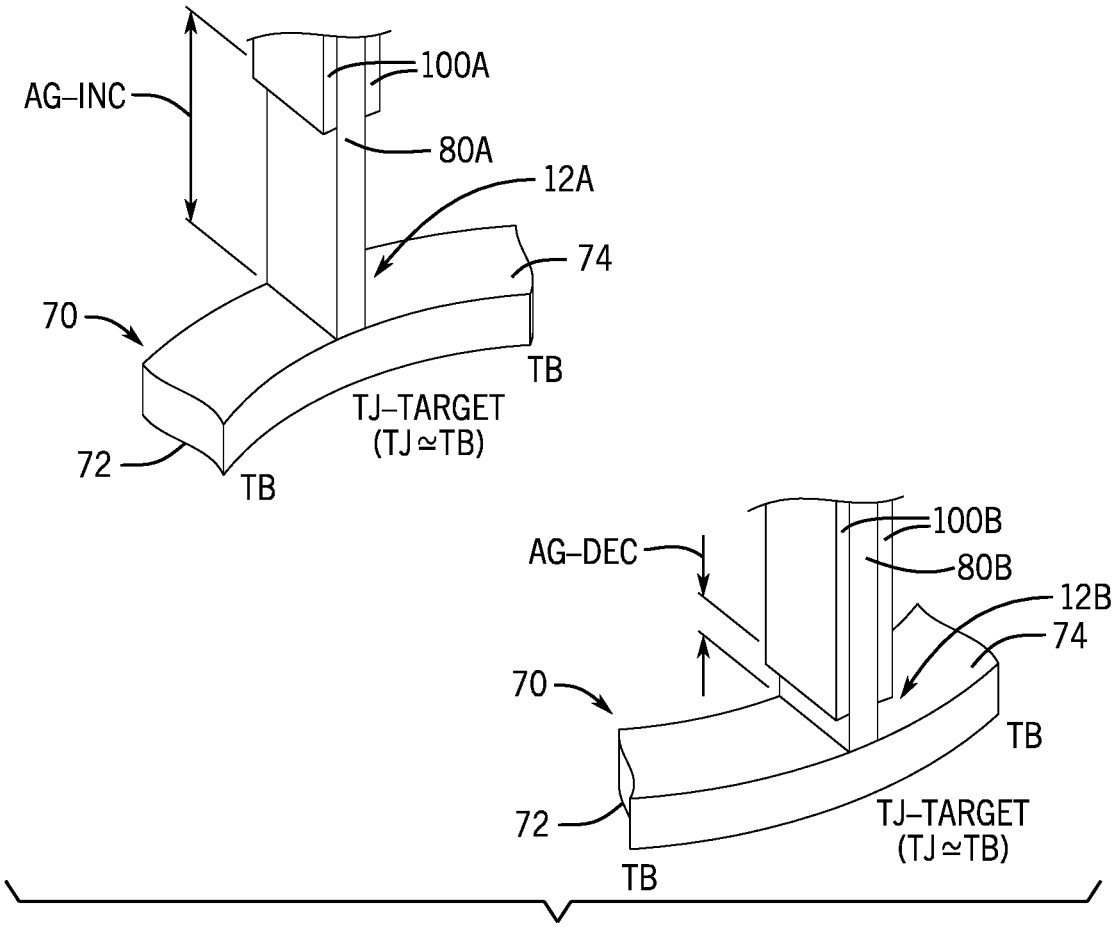
FIG. 12 is a closeup isometric view of tab/band junctions representing energy transmission tuning procedures.

Referring now to FIGS. 11 and 12 a representation of energy transmission tuning or temperature balancing is shown. In this example, different corrective actions are implemented at the tab/band junctions 12 by changing the air gap dimensions in different amounts using gap gauges 100A, 100B with different leg lengths.

Referring now to FIG. 11, an initial state is shown in which the tab/band junctions 12 (12A, 12B) have air gaps with the same dimensional magnitude, shown as initial air gap AG0 that is defined by matched-length gap gauges 100A, 100B that have the same leg lengths. FIG. 11 represents an unbalanced condition with temperature differentials defined at the band's lower or workpiece-facing surface 72 between each of the tab/tab junctions 12A, 12B and the remainder of the band 70. The tab/band junction 12A associated with tab 80A has a junction temperature TJ that is too cool or lower than the band temperature TB. The tab/band junction 12B associated with tab 80B has a junction temperature TJ that is too hot or greater than the band temperature TB. In order to provide a balanced temperatures about the entire band lower or workpiece-facing surface 72, compared to the initial state, more energy must be transferred through tab/band junction 12A associated with tab 80A to increase its heat or provide a warming effect and less energy must be transferred through tab/band junction 12B to decrease its heat to provide a cooling effect.

Referring now to FIG. 12, compared to the initial state as shown in FIG. 11, tab/band junction 12A has been adjusted to implement a gap gauge 100A with shorter legs, which increases the corresponding air gap, represented as an increased air gap AG-INC. The tab/band junction 12B has been adjusted to implement a gap gauge 100B with longer legs, which decreases the corresponding air gap, represented as a decreased air gap AG-DEC. The replacement or corrected gap gauges 100A, 100B and the corresponding changes in the air gap dimensions provide the temperatures increase at tab/band junction 12A and temperature decrease at tab/band junction 12B that provide a balanced temperature or a temperature uniformity along the entire workpiece-facing surface 72. This is represented by a junction temperature at each of the tab/band junctions 12A, 12B defining a target junction temperature TJ-TARGET at which the junction temperatures are substantially the same as the band temperature TB, such as within about 10-degrees F. different or less or within about 5% of each other.

Figure 13:
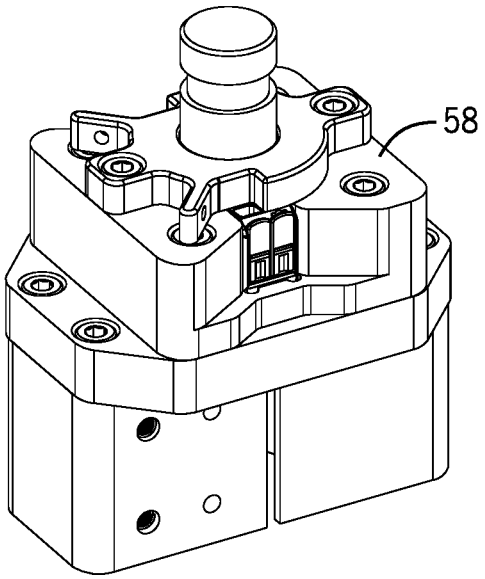
FIG. 13 is a partially exploded isometric view of another impulse heat-sealing tool implementing a heat-seal band in accordance with various aspects of the invention.
Figure 13:
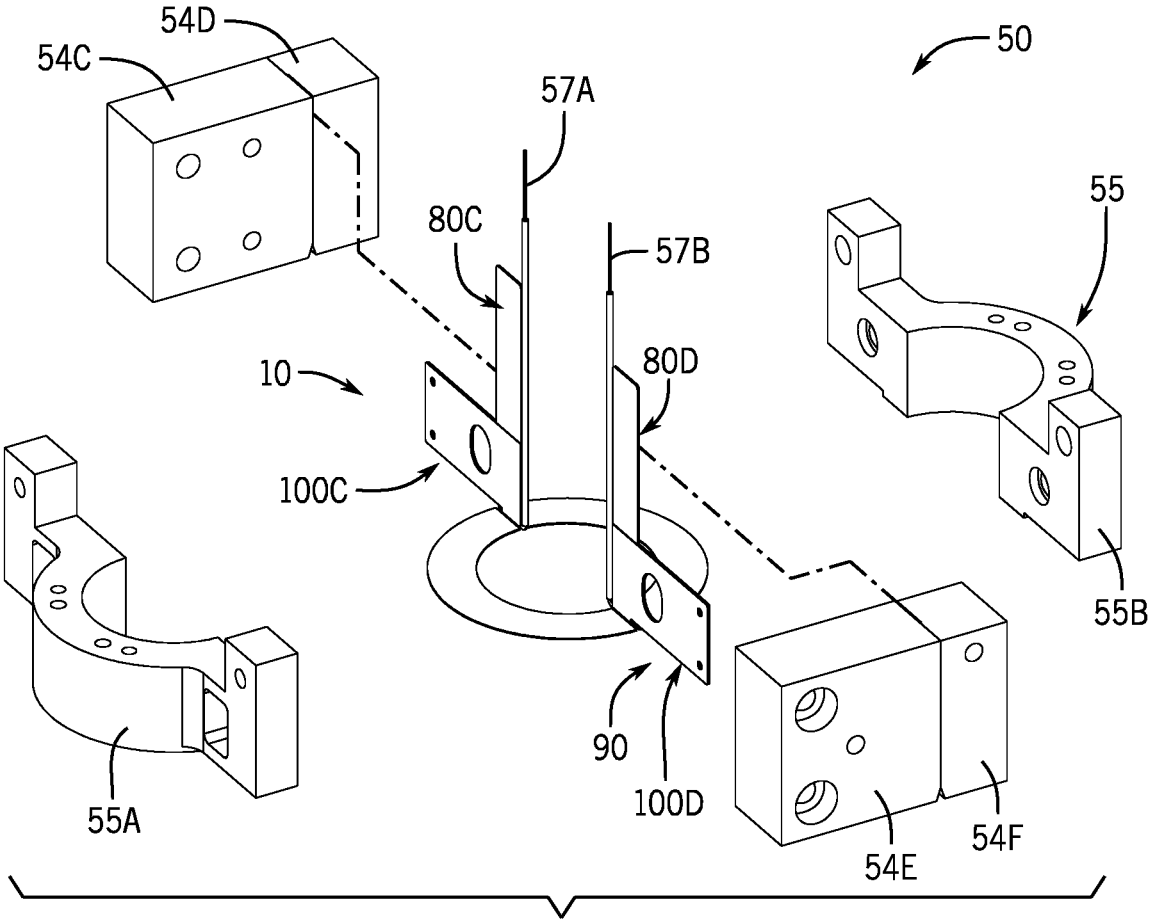

Referring now to FIG. 13, the heat-seal band 10 and heat-sealing tool 50 differ from those shown in, e.g., FIG. 2 in the following ways. Compared to the generally linear or rectangular tabs 80A, 80B of FIG. 2, heat-seal band's 10 tabs 80C, 80D shown in FIG. 13 have L-shaped configurations. Tab cover system 90 is shown with gap gauges 100C, 100D in a horizontal orientation or arranged generally perpendicularly with respect the gap gauges 100A, 100B shown in FIG. 2. Compared to that shown in FIG. 2, heat-sealing tool 50 of FIG. 13 has additional segmented components or features that are configured to separate various aspects of transmitting load current to and holding of the heat-seal band 10. Each bus bar is further segmented to clamp a respective portion of tab 80C, 80D for electrical connector-type engagement, shown as corresponding load current clamps that may, themselves, be segmented to clamp against respective upper portions of tabs 80C, 80D. A first load current clamp includes load current clamp segments 54C, 54D that are configured to clamp against the upper portion of tab 80C. At the other side of the heat-seal band 10, a second load current clamp includes load current clamp segments 54E, 54F that are shown configured to clamp against an upper portion of tab 80D. The paired load current clamp segments 54C, 54D and 54E, 54F of the load current clamps provide respective electrical terminals or connections between the tabs 80C, 80D and load lines or conductors 56A, 56B (FIG. 1).

Still referring to FIG. 13, heat-sealing tool 50 is shown with a multi-component or segmented band body holder or holder clamp 55, with a pair of holder clamp segments 55A, 55B. The holder clamp segments may be electrically insulated and thermally conductive. Holder clamp 55 is shown here configured to clamp against and retain lower portions of heat-seal band 10, such as the lower horizontally oriented segments of L-shaped tabs 80C, 80D.

Referring now to FIG. 14, toward the left-hand side of heat-seal band 10, a variable implementation of tab cover system 90 is shown with gap gauge 100C removably overlying a lower portion of tab 80C. Toward the right-hand side of heat-seal band 10, there is no gap gauge shown against the tab 80D. Absence of a gap gauge may correspond to an intermediate step between removal of a first gap gauge and the installation of a subsequent gap gauge. The absence of a gap gauge may also correspond to an implementation in which the tab cover 92 is defined by a surface of a fixed or non-adjustable component. This may include a stepped segment 93 or other surface of holder clamp 55 that engages a respective surface of the tab, represented here as a portion of clamp segment 55B that engages a corresponding surface of tab 80D, whereby a corresponding air gap may be defined as a space between, e.g., the stepped segment or surface, edge, or other surface of clamp segment 55B and an upper surface of band.

Referring generally to FIGS. 14 and 15, the tab/band junction 12 of FIG. 14 shows tabs 80C, 80D and gap gauge 100C with bottom edges that are narrower or extend across less than an entire distance across the width of band 70 at the tab/band junction 12. In FIG. 15, tabs 80E, 80F and gap gauges 100E, 100F are shown with bottom edges that are wider or extend beyond an entire distance across the width of band 70 at the tab/band junction 12.

Referring now to FIG. 16, these implementations of L-shaped tabs 80E, 80F are shown with upright segments 130 that are configured to engage electrical current connectors, such as load current clamps 54C, 54D and 54E, 54F (FIG. 13) that deliver power to the heat-seal band 10 for generating the heat-sealing heat. Sideways segments 132 are configured to receive the gap gauges 100E, 100F with the shim's 112 lower edges 120 defined in a direction of insertion into a slot of the tab's 80E, 80F sideways segment 132. Gap gauges 100E, 100F are shown as tab covers 92, each of which has is pair of legs 114 insertable over to engage the opposite facing surfaces of respective tab sideways segment 132. Typically, a lowermost segment of lower edge 118 defines the air gap between the tab cover 92 and the band's upper or tab-facing surface 74.

Other aspects and characteristics of a heat-seal band 10 falling within the scope of the present invention are disclosed in the drawings attached hereto, the disclosure of which is expressly incorporated herein.

Many changes and modifications could be made to the invention without departing from the spirit thereof. The scope of these changes will become apparent from the appended claims.

What is claimed is:

1. A heat-seal band system comprising:

a band having a workpiece-facing surface that is configured to direct heat toward a workpiece to perform a heat-sealing operation to the workpiece and an opposite tab-facing surface;

a conductive tab that extends away from the tab-facing surface and is configured to conduct electrical energy from a power source to the band;

a tab to band junction (tab/band junction) defined at an intersection of the tab and band;

an air gap arrangement adjacent the tab/band junction that includes:

a tab cover system including a tab cover that engages at least a portion of the tab; and an air gap defined as a void space between the tab cover and the tab-facing surface of the band; and wherein:

a distance between the tab cover and the tab-facing surface of the band at the air gap influences an energy transmission-related characteristic between the tab and the band at the tab/band junction;

the adjustable tab/band junction includes a variable tab cover system that is arranged in a heat-sealing tool that holds and delivers power to the heat-seal band; and the variable tab cover system is configured to selectively cover the tab to different extents to vary an amount of energy that is transmitted through the tab/band junction.

2. A heat-seal band system comprising:

a band having a workpiece-facing surface that is configured to direct heat toward a workpiece to perform a heat-sealing operation to the workpiece and an opposite tab-facing surface;

a conductive tab that extends away from the tab-facing surface and is configured to conduct electrical energy from a power source to the band;

a tab to band junction (tab/band junction) defined at an intersection of the tab and band;

an air gap arrangement adjacent the tab/band junction that includes:

a tab cover system including a tab cover that engages at least a portion of the tab; and an air gap defined as a void space between the tab cover and the tab-facing surface of the band; and wherein:

a distance between the tab cover and the tab-facing surface of the band at the air gap influences an energy transmission-related characteristic between the tab and the band at the tab/band junction adjusting a dimension of the air gap varies an amount of energy that is transmitted through the tab/band junction to provide a variable energy transition between the tab and band for adjusting an amount of heat.

3. The heat-seal band system of claim 2, wherein:

the tab/band junction defines an adjustable tab/band junction for adjusting the dimension of the air gap.

4. The heat-seal band system of claim 3, wherein:

the tab cover system defines a variable tab cover system for adjusting the tab/band junction and the dimension of the air gap.

5. The heat-seal band system of claim 4, wherein the variable tab cover system includes:

a gap gauge that engages the tab to define the air gap as a space between the gap gauge and the tab-facing surface at the adjustable tab/band junction.

6. The heat-seal band system of claim 5, wherein the gap gauge is one of a set of gap gauges that have different length dimensions and are configured to individually and removably mount to the tab to provide corresponding air gaps of different dimensions.

7. The heat-seal band system of claim 5, wherein:

the tab is one of a pair of tabs that are electrically connected to the band;

the gap gauge is one of a pair of gap gauges that are individually and removably mounted to the pair of tabs; and the pair of tabs and the pair of gap gauges define:

a first gap gauge mounted to a first tab and covering a first length of the first tab; and a second gap gauge mounted to a second tab and covering a second length of the second tab that is different than the first length.

8. The heat-seal band system of claim 6, wherein the tab and the gap gauge extend axially away from the band.

9. The heat-seal band system of claim 6, wherein:

the tab includes:

a first segment as an upright segment that extends generally axially away from the band;

a second segment as a sideways segment that extends generally perpendicularly away from the upright segment of the tab; and the gap gauge is mounted to the sideways segment of the tab.

10. The heat-seal band system of claim 6, wherein:

the tab is one of a pair of tabs that extend generally parallel to each other and perpendicularly from the band at opposite sides of the band;

the gap gauge is one of a pair of matching gap gauges and the set of gap gauges includes multiple pair of matching gap gauges for removably mounting to the pair of tabs to establish a matching air gap at the pair of tabs.

11. A heat-seal band comprising:

a band having a workpiece facing surface that is configured to direct heat toward a workpiece to perform a heat-sealing operation to the workpiece;

a conductive tab configured to conduct electrical energy from a power source to the band; and an adjustable tab to band junction (tab/band junction) that configured to be adjustable to provide a variable energy transition between the tab and band for adjusting an amount of heat.

12. The heat-seal band of claim 11, wherein:

the adjustable tab/band junction includes a variable tab cover system that is arranged in a heat-sealing tool that holds and delivers power to the heat-seal band;

the variable tab cover system is configured to selectively cover the tab to different extents to vary an amount of energy that is transmitted through the tab/band junction.

* * * * *